US005441406A

United States Patent [19]

Bunk et al.

[11] Patent Number: 5,441,406

[45] Date of Patent: Aug. 15, 1995

[54] FIRING LIQUID AND GASEOUS FUELS FOR A CIRCULATING FLUIDIZING BED REACTOR

[75] Inventors: Stanley A. Bunk, Stamford, Conn.; George Tomasicchio, Milan, Italy

[73] Assignee: Dorr-Oliver Incorporated, Milford, Conn.

[21] Appl. No.: 397,557

[22] Filed: Mar. 2, 1995

Related U.S. Application Data

[63] Continuation of Ser. No. 120,599, Sep. 13, 1993, abandoned.

[51] Int. Cl.[6] ..... F23D 19/00

[52] U.S. Cl. ..... 432/15; 432/58; 431/7

[58] Field of Search ..... 431/170, 7; 432/15, 432/58; 110/245; 122/4 D

[56] References Cited

U.S. PATENT DOCUMENTS

| | | | |
|---|---|---|---|
| 3,907,674 | 9/1975 | Roberts et al. | 210/20 |
| 3,915,657 | 10/1975 | Staffin et al. | 23/284 |
| 3,998,929 | 12/1976 | Leyshon | 423/167 |
| 4,159,682 | 7/1979 | Fitch et al. | 110/245 |
| 4,304,754 | 12/1981 | Jukkola | 422/142 |
| 4,321,233 | 3/1982 | Tsuji et al. | 431/7 |
| 4,531,907 | 7/1985 | Kawamura | 431/7 |
| 4,704,084 | 11/1987 | Liu et al. | 431/7 |
| 4,773,339 | 9/1988 | Garcia-Mallol | 122/4 D |
| 4,829,912 | 5/1989 | Alliston et al. | 122/4 D |
| 4,867,079 | 9/1989 | Shang et al. | 431/7 |
| 5,123,956 | 6/1992 | Fernandez et al. | 75/423 |
| 5,269,263 | 12/1993 | Garcia-Mallol | 110/245 |

*Primary Examiner*—Willis R. Wolfe
*Attorney, Agent, or Firm*—DeLio & Peterson

[57] ABSTRACT

A method and system for introducing combustion gases to the upper portion of the dense phase or transition portion of a circulating fluidized bed reactor. The combustion gases are produced in a burner external to the dense phase portion of the reactor wherein the burner receives a mixture of liquid or gaseous fuel and air so as to initiate and maintain combustion within the burner. The combustion gases are then quenched prior to entering the dense phase portion of the reactor so as to reduce the temperature of the combustion gases thereby preventing overheating or sintering of the particulate and significant oxidation reduction in the dense phase portion of the reactor.

21 Claims, 2 Drawing Sheets

FIRING LIQUID AND GASEOUS FUELS FOR A CIRCULATING FLUIDIZING BED REACTOR

This is a continuation of application Ser. No. 08/120,599 filed on Sep. 13, 1993, now abandoned.

BACKGROUND OF THE INVENTION

1. Field of the Invention

This invention is directed to circulating fluidized bed reactors, and more particularly, to the introduction of combustion gases derived from liquid and gaseous fuels into such reactors.

2. Description of Related Art

A fluid bed reactor is a vertical, cylindrical vessel which generally is comprised of three functional sections: (a) the windbox, or lower section, located beneath a constriction plate, (b) the fluid bed (bubbling regime) or dense phase (CFB regime), immediately above the constriction plate, and (c) the freeboard (bubbling regime) or dilute phase (CFB regime), the uppermost section where solids are disengaged from the upward moving gas stream.

Fluidization is the suspension of solids by an upward gas stream. The suspended mixture of solids with gases resembles a fluid. A fluid bed is a mixture of solids and gases in suspension contained in the lower-middle portion of the fluid bed reactor. The fluid bed is bound by the reactor walls on the sides and contained by the constriction plate on the bottom. The top of the bed looks like an irregular splashing, boiling surface. A reactor that has such a fluid bed is known in the art as a "bubbling" fluid bed reactor. A reactor in which particles are recirculated is known as a circulating fluidized bed (CFB) reactor. The boundary between the upper and lower zones becomes much less distinct. Pulsations or "bubbling" is diminished in a CFB reactor. Typically CFB reactors are utilized in the boiler industry wherein solid fuels, i.e., coal, coke, wood, rubber, etc., are fired in the reactor.

Fluidized bed reactors are extremely versatile apparatuses, which, in various forms, can carry out the processes of drying, sizing, roasting, calcining, heat treatment of solids with gases in the chemical, metallurgical and other materials processing fields, and the generation of hot gases, including steam, for use in driving electric power generation equipment. Fluidized bed reactors have also been successfully applied to the incineration of combustible waste streams such as sewage sludge and oil refinery wastes.

Direct injection of liquids, solids and gaseous fuels into "bubbling" fluid bed reactors is known in the art. Since "bubbling" fluid bed reactors operate at relatively low velocities, a high percentage of the heat released (oxidation) usually occurs in the fluid bed rather than in the freeboard zone, the cyclone, or the exhaust gas ducts. Excessive heat release in the freeboard zone causes severe operational problems which include, but are not limited to, scaling, poor temperature control, increased energy requirements, poor product quality and overheating of the cyclone and exhaust gas ducts.

CFB reactors are operated at higher velocities. Direct injection of solid fuels into CFB reactors produces heat release primarily in the lower zone (dense phase). Contrary to the "bubbling" lower fluid bed reactors, some heat release (oxidation) in the upper zone (dilute phase) does not pose a significant problem. However, it has been found that direct injection of liquid and gaseous fuels into conventional CFB reactors greatly reduces the heat release (oxidation) in the lower zone (dense phase) thereby causing overheating of the upper zone (dilute phase), the cyclone and associated exhaust gas ducts. Such overheating causes many operational deficiencies which include, but are not limited to, scaling, poor temperature control, increased energy requirements and poor product quality. Due to these operational problems, direct injection of liquid and gaseous fuels in high velocity CFB reactors is not typically practiced.

Several approaches have been utilized in order to avoid the problems associated with direct injection of liquid and gaseous fuels into CFB reactors. For example, reaction kinetics can be enhanced by using an oxygen enriched fluidized system. However, the utilization of an oxygen enriched fluidized system requires the use of an oxygen plant thus increasing the costs and complexity of such a system. The fluidizing gas is preheated using direct or indirect combustion. However, there are significant limitations on the amount of energy which can be inputted to the system by preheating the fluidizing gases.

Another attempt to solve the above-mentioned problems is to heat the CFB reactor by directly firing burners into the reactor. The burner can operate using either liquid or gaseous fuels. However, direct firing causes sintering, which is a loss of product quality for temperature sensitive feed particulate.

Bearing in mind the problems and deficiencies of the prior art, it is therefore an object of the present invention to provide a new and improved circulating fluidized bed reactor system wherein combustion gases derived from liquid or gaseous fuels are introduced into the dense phase of the reactor without causing significant reduction of oxidation in the dense phase.

It is another object of the present invention to provide a new and improved circulating fluidized bed reactor system which utilizes burners external to the reactor which oxidizes liquid or gaseous fuels sufficiently so as to provide combustion gases having low levels of carbon monoxide and unoxidized hydrocarbons.

It is a further object of the present invention to provide a new and improved circulating fluidized bed reactor system which does not utilize an oxygen enriched fluidized system.

It is yet a further object of the present invention to provide a new and improved circulating fluidized bed reactor system wherein the combustion gases are quenched prior to being introduced into the transition or dense phase portion of the reactor so as to prevent sintering or overheating of the feed particulate.

It is another object of the present invention to provide a new and improved circulating fluidized bed reactor system wherein the quenching air utilized to quench the combustion gases may be preheated by processed particulate.

It is further object of the present invention to provide a new and improved circulating fluidized bed reactor system which can be constructed and operated for reasonable costs.

SUMMARY OF THE INVENTION

The above and other objects, which will be apparent to those skilled in the art, are achieved in the present invention which is directed to, in a first aspect, a method for providing a combustion gas to a circulating fluidized bed reactor comprising the steps of providing a mixture comprised of air and fuel, initiating and maintaining combustion of the mixture so as to produce combustion gases, quenching the combustion gases so as to reduce the temperature thereof, and introducing the quenched combustion gases to the transition or dense phase portion of a circulating fluidized bed reactor.

In a related aspect, the present invention is directed to a method of operating a circulating fluidized bed reactor system comprising the steps of providing a circulating fluidized bed reactor, providing a source of fluidizing gas to the windbox of the reactor, providing feed particulate to the fluidization portion of the fluidized bed reactor so as to form a fluidized bed of particulate upon the gas permeable constriction plate of the reactor, providing a burner external to the reactor, providing a mixture of air and fuel to the burner so as to initiate and maintain combustion within the burner thereby producing combustion gases, quenching the combustion gases so as to reduce the temperature of the combustion gases, thereafter introducing the combustion gases to the transition or dense phase portion of the reactor so as to effect a transfer of heat from the combustion gases to the fluidized particulate, returning the solid constituents of the off-gases produced by the heat transfer to the fluidization portion of the reactor, and removing processed particulate from the lower portion of the reactor.

In a further aspect, the present invention is directed to a circulating fluidized bed reactor system comprising a circulating fluidized bed reactor, and at least one burner, the burner having a first inlet for receiving air and fuel for initiating and maintaining combustion within the burner so as to produce combustion gases, the burner having a second inlet for receiving quenching air for reducing the temperature of the combustion gases, the burner having a outlet connected to the transition or dense phase portion of the reactor so as to allow the quenched combustion gases to enter therein.

DESCRIPTION OF THE PREFERRED EMBODIMENTS

Figure 1:
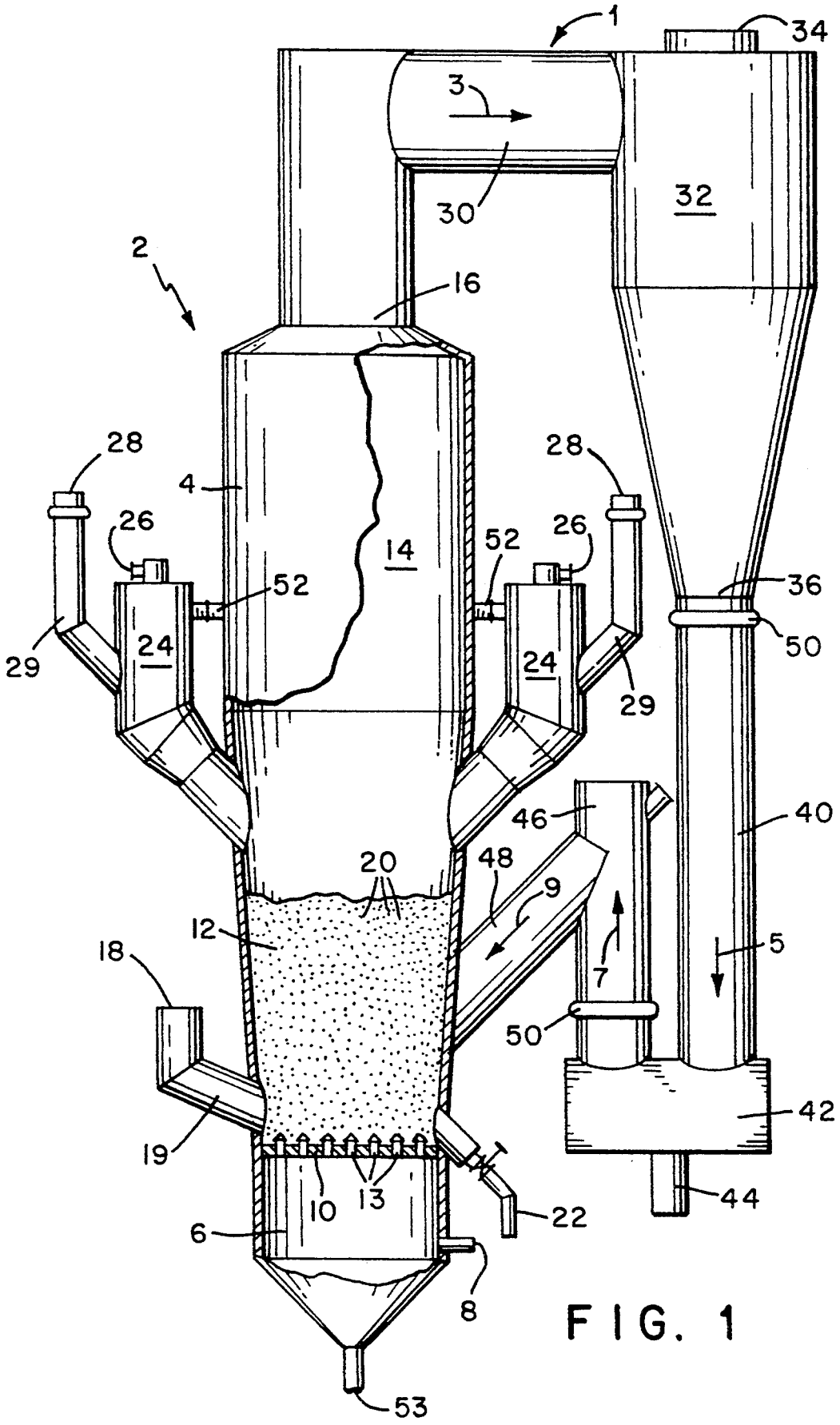
FIG. 1 is a side elevational view of the circulating fluidized bed reactor system of the present invention.

Referring to FIG. 1, circulating fluidized bed reactor system 1 of the present invention comprises fluid bed reactor 2, burners 24, duct 30, cyclone 32, duct 40, valve 42 and ducts 46, 48. Fluid bed reactor 2 comprises shell 4, windbox 6, gas permeable constriction plate 10, dense or transition phase portion 12 and dilute phase portion 14. Particulate 20, having been reduced to a predetermined particle size, is fed into inlet 18 of duct 19 so as to form a bed of particulate upon substantially horizontal constriction plate 10. Constriction plate 10 has a plurality of apertures or tuyeres 13 so as to receive a supply of fluidizing air from windbox 6 thereby maintaining particulate 20 in a fluidized state (tuyeres are nozzles or comparable devices at the bottom of the fluid bed for distribution of the fluidizing gases across the entire cross-sectional area of the bed). The fluidizing air is fed into windbox inlet 8 of windbox 6 by a blower (not shown). Windbox drain 53 collects any particulate which has fallen through the tuyeres. In a preferred embodiment, particulate 20 is maintained in a fluidized state by air. However, other oxygen-containing gases may be utilized. Particulate 20 is supported on the rising column of fluidizing air so that the particulate behaves in much the same fashion as a liquid. Fresh particulate that is added to the bed is quickly and uniformly distributed by this fluidization process. The bed of particulate 20 is held in a constant state of agitation and suspension so that the transfer of heat from the combustion gases (produced by external burners 24) to fluidized particulate 20 is instantaneous and uniform.

Figure 2:
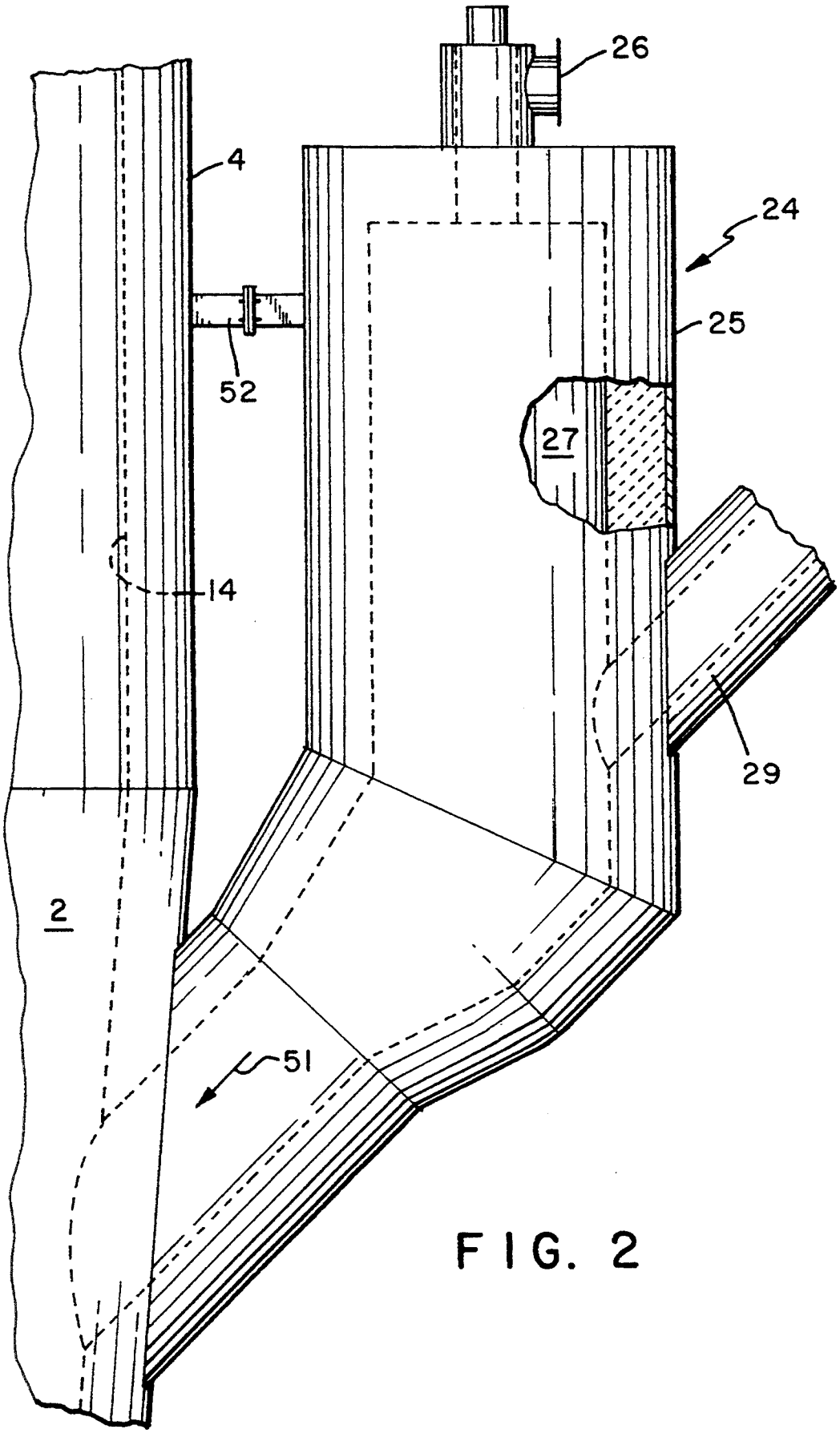
FIG. 2 is an enlarged side elevational view of the external burners utilized in the circulating fluidized bed reactor system shown in FIG. 1.

Referring to FIGS. 1 and 2, burner 24 comprises burner housing 25, fuel and combustion air inlet 26, quenching air inlet 28, duct 29 and burner chamber 27. Burner 24 is supported by reactor 2 via support member 52. A mixture of liquid or gaseous fuel and air is fed into inlet 26. The fuel-to-air ratio of the mixture is sufficient to initiate and maintain combustion within burner chamber 27. The combustion air in the fuel/air mixture is approximately 120 to 180%, preferrably 150% of stoichiometric requirements so as to provide a resulting combustion gas temperature of about 2200° F.-2800° F. Burner 24 oxidizes or burns the fuel/air mixture sufficiently so as to provide a combustion gas having low levels of carbon monoxide and unoxidized hydrocarbons. Prior to introducing the combustion gases to transition or upper dense phase portion 12, the combustion gases are quenched by a supply of quenching air that is fed into inlet 28 and transferred to chamber 27 by duct 29. The temperature of the quenching air is from about 700° F. to about 1200° F. However, in a preferred embodiment, the temperature of the quenching air is about 1000° F. Quenching may also be effected with ambient air having a temperature of approximately 100° F. The quenching air reduces the temperature of the combustion gases to about 1800° F. The reduction in combustion gas temperature prevents overheating or sintering of particulate 20 and also prevents significant oxidation reduction in transition or dense phase portion 12. The quenching air may be preheated indirectly or directly by the processed particulate which is withdrawn from outlet 22. Once quenched, the combustion gases are fed into transition or upper dense phase portion 12 (arrow 51 in FIG. 2 designates the combustion gas flow path). The transfer of heat from the combustion gases to the fluidized particulate in transition or upper dense phase portion 12 is uniform and instantaneous. Introduction into the transition or upper dense phase portion effects energy input to this zone, and not dilute phase portion 14 thereby preventing overheating of portion 14 and attached auxiliary equipment, i.e., duct 30, cyclone 32 and duct 34.

Dilute phase portion 14 receives the off-gases as low density concentrations of particulate resulting from the transfer of heat from the combustion gases to particulate 20. The off-gases are comprised of gaseous and entrained solid constituents. The off-gases pass through outlet 16 into duct 30 which is connected to the inlet of cyclone 32 (arrow 3 designates the flow path of the off-gases). Cyclone 32 separates the gas from a majority of the entrained solids wherein the gas is discharged through duct and vortex finder outlet 34 and the entrained solids are discharged through outlet 36. Underflow outlet 36 is connected to duct 40 by expansion joints 50. The entrained solids which are discharged through underflow outlet 36 of cyclone 32 travel through duct 40 into valve 42 (arrow 5 designates the flow path of the discharged entrained solids). Valve 42 is preferably a FluoSeal TM manufactured by Dorr- Oliver, Incorporated of Milford, Conn. A FluoSeal is a U-tube containing fluidizable solids or particulate. Fluidizing gas is fed into the bottom of the U. The device acts as a pressure seal thereby permitting the fluidizable solids to be drawn out of or into vessels with pressure above or below the ambient pressure. However, non-mechanical type valves such as "J" or "L" valves may also be utilized. A blower (not shown) supplies air or other fluidizing gases to inlet 44 of valve 42 so as to maintain fluidization of the solids within valve 42. The fluidization is necessary in order to effect a uniform distribution of the solid particulate within valve 42 through ducts 46, 48 and into dense phase portion 12 (arrows 7 and 9 designate the flow path of the fluidized solids). Valve 42 constantly retains an amount of solid constituents therein sufficient to prevent the combustion gases from passing in a direction opposite that shown by arrows 9 and 7. Expansion joints 50 connect valve 42 to duct 46.

The quantity of burners 24 utilized in the system is dependent upon the size of the circulating fluidized bed reactor utilized, and the type of process to be implemented, i.e. calcining, roasting, etc. The system of the present invention may be utilized to achieve a variety of processes, including, but not limited to, calcining phosphate-type rock or alumina, burning carbon or other organic substances lodged on feed particulate, producing chemical reactions, e.g. converting calcium carbonate to calcium oxide or carbon dioxide, producing a sulfate from previously formed calcium oxide, producing sulfur dioxide from sulfide ore and reforming calcium sulfate. The system of the present invention may be utilized to achieve other types of homogeneous and heterogeneous type reactions. Furthermore, the system of the present invention may also be adapted for use with "fast fluidized" CFB reactors.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus having described the invention, what is claimed is:

1. A method for providing a combustion gas to a circulating fluidized bed reactor comprising a shell having a lower portion and an upper portion, said reactor further comprising a dense phase portion located in said lower portion and a dilute phase portion located in said upper portion, comprising the steps of:

(a) providing a mixture comprised of air and fuel;

(b) initiating and maintaining combustion of said mixture external to said shell to produce combustion gases;

(c) quenching said combustion gases external to said shell to reduce the temperature of said combustion gases; and (d) thereafter introducing said quenched combustion gases to said dense phase portion of the circulating fluidized bed reactor.

2. The method of claim 1 wherein said quenching air is preheated by processed particulate withdrawn from the reactor.

3. The method of claim 1 wherein said quenching air has a temperature from about 700° F. to about 1200° F.

4. The method of claim 3 wherein the air in said mixture is excessive so as to provide a combustion gas temperature from about 2200° F. to about 2800° F.

5. The method of claim 4 wherein said quenching air reduces the temperature of said combustion gases so as to prevent overheating or sintering of the particulate and significant oxidation reduction in the dense phase portion of said reactor.

6. The method of claim 5 wherein said mixture is oxidized sufficiently so as to provide low levels of carbon monoxide and unoxidized hydrocarbons.

7. The method of claim 6 wherein said fuel is a gas.

8. The method of claim 6 wherein said fuel is a liquid.

9. A method of operating a circulating fluidized bed reactor system, comprising the steps of:

(a) providing a circulating fluidized bed reactor comprising a shell having a lower portion and an upper portion, said reactor further comprising a dense phase portion located in said lower portion and a dilute phase portion located in said upper portion;

(b) providing feed particulate to said dense phase portion to form a fluidized bed of particulate;

(c) providing at least one burner external to said shell;

(d) providing a mixture of air and fuel to said burner so as to initiate and maintain combustion within said burner thereby producing combustion gases;

(e) quenching said combustion gases external to said shell to reduce the temperature of said combustion gases;

(f) thereafter introducing said quenched combustion gases to said dense phase portion to effect a transfer of heat from said quenched combustion gases to the fluidized particulate;

(g) returning the solid constituents of the off-gases produced by said heat transfer in step (f) to said dense phase portion; and (h) removing processed particulate from said dense phase portion.

10. The method of claim 9, wherein said step of returning comprises the steps of:

(a) recovering, in the dilute phase portion of said reactor, the off-gases produced by said heat transfer;

(b) providing a cyclone;

(c) introducing the off-gases recovered in the dilute phase portion to the inlet of said cyclone;

(d) separating the solid constituents of the off-gases from the gaseous constituents of the off-gases whereby the solid constituents are discharged from the underflow outlet of said cyclone;

(e) fluidizing the solid constituents discharged from the underflow outlet of said cyclone; and (f) thereafter introducing said fluidized solid constituents to the dense phase portion of said reactor so as to expose said fluidized solid constituents to said combustion gases.

11. The method of claim 9 wherein the temperature of said quenching air is from about 700° F. to about 1200° F.

12. The method of claim 11 wherein the air in said mixture is excessive so as to provide a combustion gas temperature from about 2200° F. to 2800° F.

13. The method of claim 12 wherein said quenching air reduces the temperature of said combustion gases so as to prevent overheating or sintering of the feed particulate and significant oxidation reduction in the dense phase portion of said reactor.

14. The method of claim 13 wherein said fuel is a gas.

15. The method of claim 13 wherein said fuel is a liquid.

16. A circulating fluidized bed reactor system, comprising:

a circulating fluidized bed reactor comprising a shell having a lower portion and an upper portion, said reactor further comprising a dense phase portion located in said lower portion and a dilute phase portion located in said upper portion, and;

at least one burner external to said shell, said burner having a first inlet for receiving air and fuel for initiating and maintaining combustion within said burner so as to produce combustion gases, said burner having a second inlet for receiving quenching air for reducing the temperature of said combustion gases, said burner having an outlet connected to said shell for introducing said quenched combustion gases to said dense phase portion.

17. The system of claim 16 wherein the temperature of said quenching air is from about 700° F. to about 1200° F.

18. The system of claim 17 wherein the air received in said burner to initiate and maintain combustion is excessive so as to provide a resulting combustion gas temperature from about 2200° F. to 2800° F.

19. The system of claim 18 wherein said quenching air reduces the temperature of said combustion gasses so as to prevent overheating or sintering of said particulate and significant oxidation reduction in said dense phase portion of said reactor.

20. The system of claim 19 wherein said fuel is a gas.

21. The system of claim 19 wherein said fuel is a liquid.

* * * * *